US007255592B1

(12) United States Patent
Tseng

(10) Patent No.: US 7,255,592 B1
(45) Date of Patent: Aug. 14, 2007

(54) ELECTRICAL WIRE CONNECTOR

(75) Inventor: Peter Tseng, Taipei Hsien (TW)

(73) Assignee: Heavy Power Co., Ltd., Taipei Hsien (TW)

( * ) Notice: Subject to any disclaimer, the term of this patent is extended or adjusted under 35 U.S.C. 154(b) by 0 days.

(21) Appl. No.: 11/436,982

(22) Filed: May 19, 2006

(51) Int. Cl.
*H01R 4/24* (2006.01)

(52) U.S. Cl. ..... 439/439; 439/787

(58) Field of Classification Search ..... 439/436–441, 439/786, 787

See application file for complete search history.

(56) References Cited

U.S. PATENT DOCUMENTS 4,397,514 A * 8/1983 Durand et al. ..... 439/436
4,824,395 A 4/1989 Blaha
5,454,730 A * 10/1995 Tozuka ..... 439/438
6,257,919 B1 7/2001 Cutler et al.
6,746,286 B2 6/2004 Blaha

* cited by examiner

*Primary Examiner*—Tho D. Ta
(74) *Attorney, Agent, or Firm*—Arent Fox LLP

(57) ABSTRACT

A push-in wire connector for electrically interconnecting multiple wires together is disclosed to have a guide and lock element, which is mated with a conduction and retention element and assembled inside the enclosing space of an enclosing element. Multiple wire insertion channels are provided inside the connector for receiving the insertion of wires. Each of the insertion channels includes a main port section led in by an insertion port for guiding the insertion of a stripped end of a wire. A wire engagement segment follows the main portion section formed by the surrounding of a conduction plate at the bottom, an insertion channel separation wall at one or both sides, and the resilient spring legs on the top. The wire engagement segment prevents the bending or deflection of the inserted wire end thereby ensuring secure and good electrical conduction between the inserted wires.

10 Claims, 7 Drawing Sheets

ELECTRICAL WIRE CONNECTOR

BACKGROUND

1. Field of the Invention

The present invention relates in general to an electrical connector for wires and, more particularly, to a push-in connector for connecting multiple wires electrically together.

2. Description of the Related Art

Push-in wire connectors are useful for connecting multiple wires electrically together in applications including providing utility power gridwork for homes and offices, etc. U.S. Pat. No. 4,824,395 "Push-in wire connector" to Blaha, for example, disclosed a wire connector having a conductive clip of relative simple design for easy fabrication. The clip responsible for providing electrical connection between the connected wires was enclosed in a housing. The clip was made in the form of a cantilever spring so that a wire inserted through an aperture in the housing can deflect the spring and be clamped and retained in the housing. Blaha's wire connector, though simple and easy to manufacture, required its single piece clip to provide both good electrical conduction between and firm mechanical retention of the wires to be electrically connected together.

Such a dual-role requirement placed limitation to the selection of suitable metallic or alloy material for clips, resulting in the necessity of a compromise between electrical conduction and mechanical retention strength characteristics required for the application. U.S. Pat. No. 6,257,919 "Electrical connector with improved locking means" to Cutler et al. disclosed a connector aimed at improved locking interconnection between the connected wires and the connector. Cutler et al. proposed an electrical contact component accommodated inside an enclosure with at least two spring locking clips. The contact component served to provide the electrical conduction between all the wires to be connected, while the spring locking clips were responsible for the mechanical retention of the connected wires.

The wire connector by Cutler et al. avoided the problem of the use of a dual-role metallic or alloy material optimized for both electrical conduction and mechanical strength for its contact component. However, since the contact component also constituted the main and bulk metallic structure for the connector, an optimized material such as copper alloy for the contact component can still be costly for the connector. U.S. Pat. No. 6,746,286 "Push-in wire connector" to Blaha was able to alleviate this cost-performance problem by introducing a busbar in the form of, rather than serving as the main metallic structure, a contact plate having the minimum required size for good electrical conduction between the wires to be connected.

However, all these prior wire connectors failed to simultaneously provide good electrical conduction and ease of use while being cheap and simple to manufacture. For example, while the connector by Cutler et al. provided good mechanical wire retention characteristics and Blaha's busbar-equipped connector achieved improved electrical conduction for the connected wires, all failed to consider the true ease of use. As a wire to be connected by any of these connectors is pushed in, the stripped wire end inserted tends to be bent or deflected sideways since the leg of the resilient clip presents a considerable resistance to the insertion of the wire end. The resistance becomes stronger as the clip is made more resilient to ensure good mechanical retention of the wire.

Although the connector by Cutler et al. did include parallel guide ribs to assist in holding wire end in the correct orientation during insertion, however, vertical height of these ribs were insufficient that there were still the possibility of wire end sideway deflection or bending to result in failed insertion. This is particularly a problem in the case of multi-threaded wires.

Blaha's busbar connector was not free of this problem as well. The Blaha connector included rear receptacles for receiving the ends of the inserted wires, however, these receptacles were not helpful at all in preventing the sideway deflection or bending of the wire end during the insertion. They only serve to provide a space for receiving the wire end—after a successful insertion. Neither were the extensions in the Blaha busbar connector of any substantial assistance in preventing the deflection or bending of the inserted wire ends since their primary goal was to hold the busbar in place and they were positioned way behind the point of pressed contact between the legs and the wires along the direction of wire insertion.

SUMMARY OF THE INVENTION

It is therefore an object of the present invention to provide an electrical wire connector for electrically connecting multiple wires together that provides both optimized mechanical retention strength of and electrical connection between the wires while is cheap to manufacture and ensures ease of use via prevention of insertion failure.

The present invention achieves the above by providing an electrical wire connector for connecting wires electrically together, the connector comprising a guide and lock means having at least one separation wall extending along the direction of insertion of said wires; a conduction and retention means having at least one resilient spring leg and a conduction plate; and an enclosing means enclosing the guide and lock means mated with the conduction and retention means for securedly holding the conduction and retention means therein, wherein the at least one separation wall, the at least one resilient spring leg and the conduction plate forming a wire engagement segment for completely surrounding stripped end of each of the wires inserted thereby preventing the stripped wire end from deflecting out of the wire insertion channel.

The present invention further provides an electrical wire connector for connecting wires electrically together, the connector having an enclosing means enclosing therein a conduction and retention means mated with a guide and lock means, the guide and lock means having at least one separation wall, the conduction and retention means having at least one resilient spring leg and a conduction plate, the connector comprising at least one wire engagement segment formed by the at least one separation wall, the at least one resilient spring leg and the conduction plate surrounding the wire insertion channel for completely surrounding stripped end of each of the wires inserted thereby preventing the stripped wire end from deflecting out of the wire insertion channel.

DETAILED DESCRIPTION OF THE PREFERRED EMBODIMENT

Figure 1:
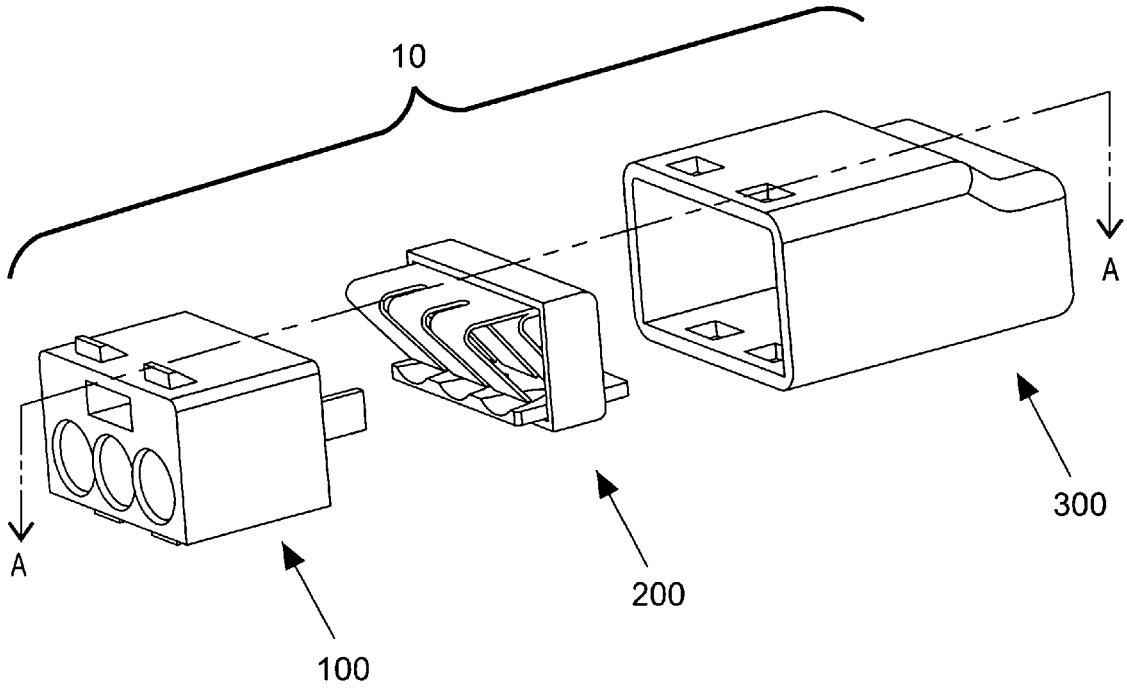
FIG. 1 is an exploded perspective view of the wire connector in accordance with a preferred embodiment of the present invention.
Figure 6:
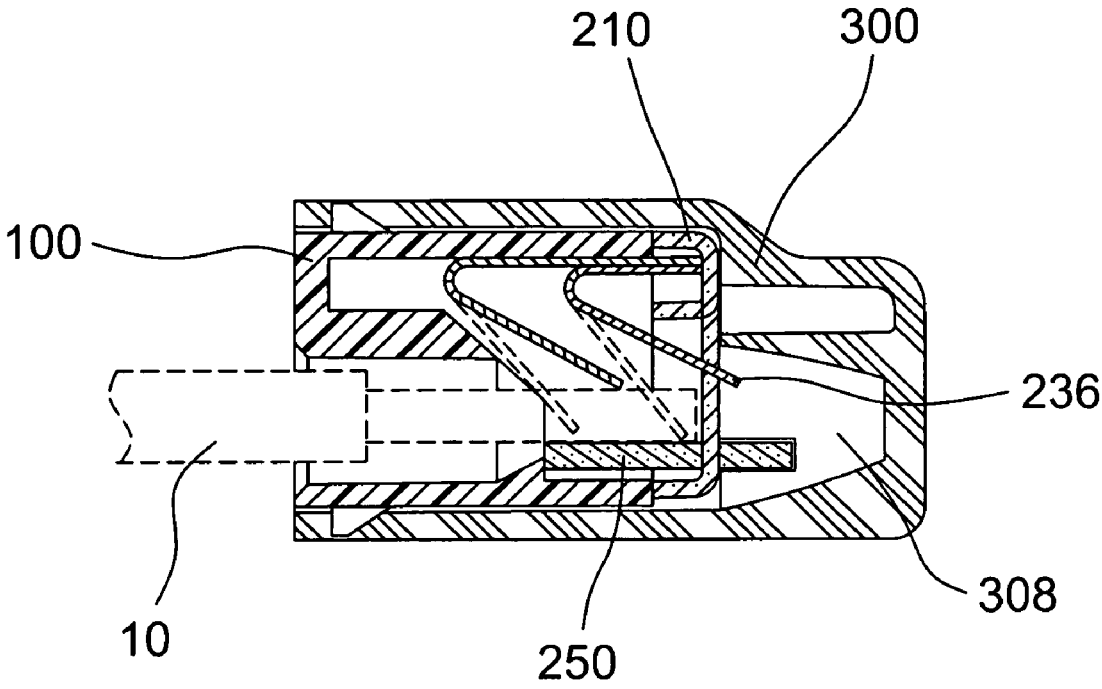
FIG. 6 is a cross-sectional view of the wire connector of FIG. 1 in an assembled status.

FIG. 1 is an exploded perspective view of a push-in wire connector in accordance with a preferred embodiment of the present invention. The wire connector 10 comprises three components including a guide and lock element 100, a conduction and retention element 200 and an enclosing element 300. FIG. 6 is a cross-sectional view of an assembled wire connector of FIG. 1. With simultaneous reference to FIGS. 1 and 6, a wire connector 10 according to the preferred embodiment of the present invention is assembled using these three connector elements 100, 200 and 300.

When assembling, the conduction and retention element 200 mates with the guide and lock element 100 and then the mating slides into the opening of the enclosing element 300 and securedly locked therein as is depicted in the cross-sectional view of FIG. 6. This is clearly illustrated in the cross-sectional view of FIG. 6 by different shading for each of the three elements 100, 200 and 300.

As an assembled wire connector 10, the conduction and retention element 200 is securedly clamped inside the enclosing element 300 by the guide and lock element 100. The conduction and retention element 200 is able to provide good electrical connection between the wires inserted and pushed into the connector 10 in a mechanically secured manner. The enclosing element 300, which practically encloses the entire conduction and retention element 200 completely inside, serves to provide electrical insulation for the contacts between the conduction and retention element 200 and its inserted wires.

Figure 2:
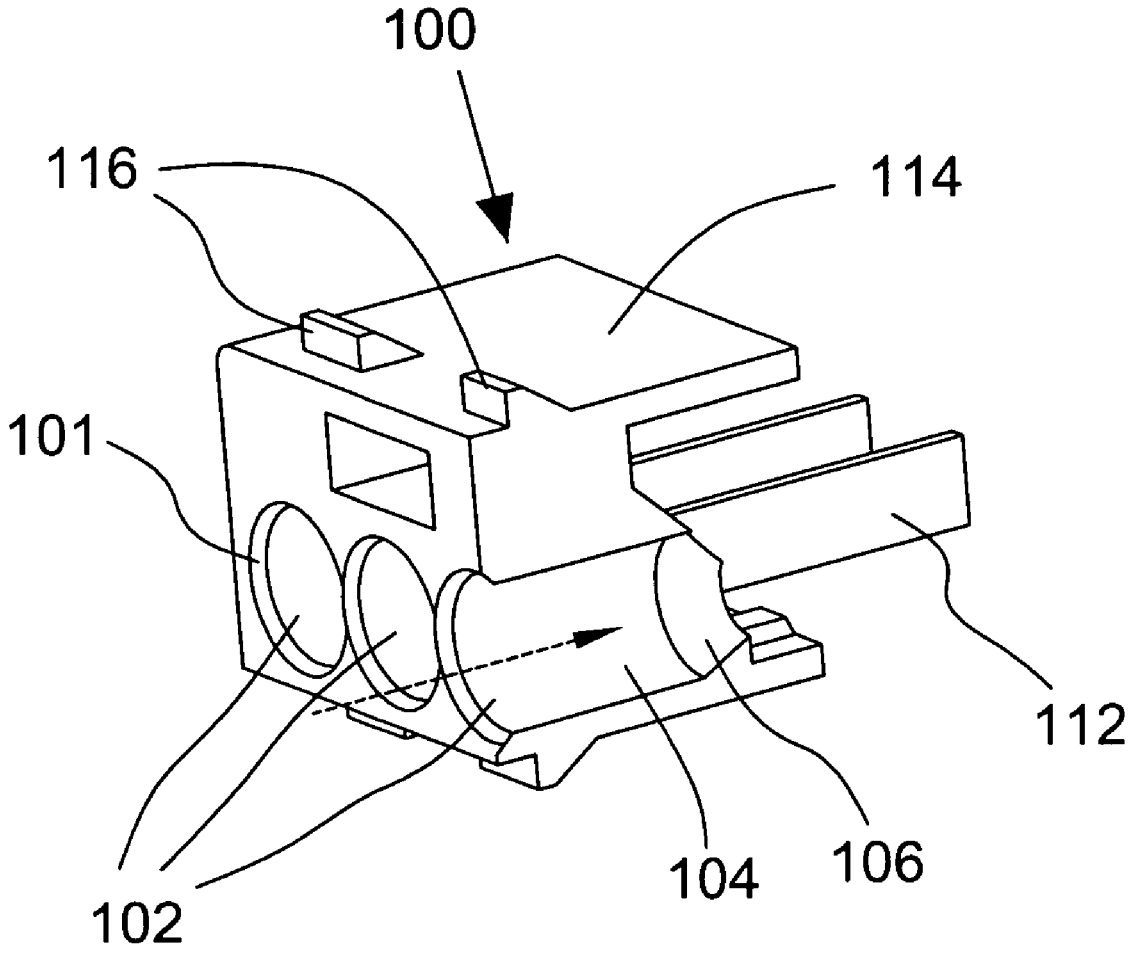
FIG. 2 is a cut away perspective view of the guide and lock element for the wire connector of FIG. 1.

FIG. 2 is a cut away perspective view of the guide and lock element 100 for the wire connector 10 of FIG. 1. The illustration shows the cross-sectional view of the element 100 cut along the A-A direction in FIG. 1. The guide and lock element 100 has a number, three in the depicted example, of wire insertion ports 102 each shaped generally as an elongated hollow opening extending along the direction of wire insertion. All wire insertion ports 102 are arranged substantially in parallel with the central axis of the hollow opening of each of the ports 102 substantially lying in the same plane.

An entry section 101 for each of the wire insertion ports 102 is an enlarged section generally in the form of a section of a cone as shown in the drawing. The entry section 101 gradually reduces its size in diameter to that of a main section 104 behind the hollow opening of the port 102. At the end of the main section 104 for each of the insertion port 102, a shrunk section 106 further reduces the size of the main section 104. This arrangement assists to guide the insertion of a wire pushed into the connector 10 (as is schematically shown in FIG. 2 by the phantom arrow) and toward the desired location inside the connector so as to effect a secured engagement between the inserted wire and the contact part of the conduction and retention element 200 in the manner to be described subsequently.

Behind the row of wire insertion ports 102 and between every pair of two neighboring ports, an insertion channel separation wall 112 extends along the direction of wire insertion. Each of these separation walls 112 extends from the end of the wire insertion ports 102 for a length reaching substantially behind the end of the conduction and retention element 200 when assembled. These separation walls 112 serve to provide physical separation between every pair of two neighboring wire insertions so that a wire inserted into one channel does not bend or deflect sideways into the next channel.

An alignment plate 114 also generally extending from about the end of the wire insertion ports 102 but at the top of the structural body of the guide and lock element 100 is used to align and secure the conduction and retention element 200 correctly inside the connector 10 when assembled. At least one enclosure locking means such as a protrusion 116 is provided on at least one leading edge of the guide and lock element 100, preferably two locking means 116 on both the top and bottom longer leading edges of the element 100 as is illustrated in the drawing.

Figure 5:
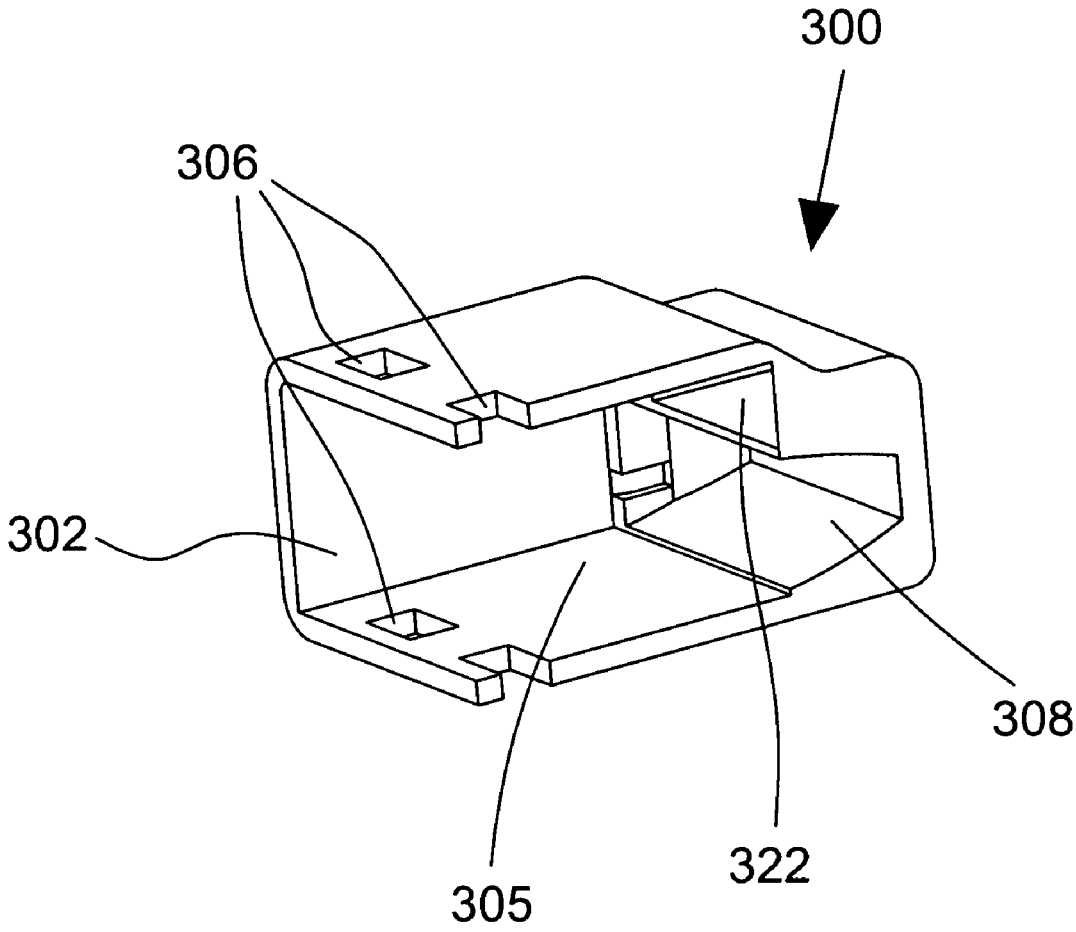
FIG. 5 is a cut away perspective view of the enclosing element for the wire connector of FIG. 1

FIG. 5 is a perspective view of the enclosing element 300 for the wire connector 10 of FIG. 1. Enclosing element 300 is in the shape of a generally solid rectangular box with a wide opening 302 facing toward the direction of wire insertion into the connector. Wide opening 302 allows for the installation of the guide and lock element 100 (together with a conduction and retention element 200 mated therewith) into the enclosing space 305 inside the element 300. Enclosure locking means such as lock openings 306 are formed on the leading edges of the enclosing element 300 at locations corresponding to the locking protrusions 116 of the guide and lock element 100. In the embodiment shown, when both elements 100 and 300 are interlocked to form an assembled connector, each protrusion 116 of element 100 mates with a corresponding lock opening 306 formed on the sidewall of the element 300.

Deep at the end of the internal enclosing space 305 opposite to the wide opening 302 of the enclosing element 300, a wire end extension space 308 may be aligned with the imaginary channels for wire insertion leading from the wire insertion ports 102 when a guide and lock element 100 is assembled in place. The wire end extension space 308 has a height lower than that of the main enclosing space 305 inside the enclosing element 300. A vertical wall generally identified as 320 helps to secure the conduction and retention element 200 inside the enclosing element 300 in the right position when mated with the guide and lock element 100 and installed therein. Note that recesses 322 are shown in the vertical wall 320. These recesses may be necessary if an enclosing element 300 is to be made by processes such as injection molding, and they also contribute to reduce the material costs for the enclosing element 300.

As is comprehensible, both the guide and lock element 100 and the enclosing element 300 are, preferably, made of insulating material commonly used for electric components. Suitable materials are such as plastics and the components can be made using, preferably, injection molding fabrication technique.

Figure 3:
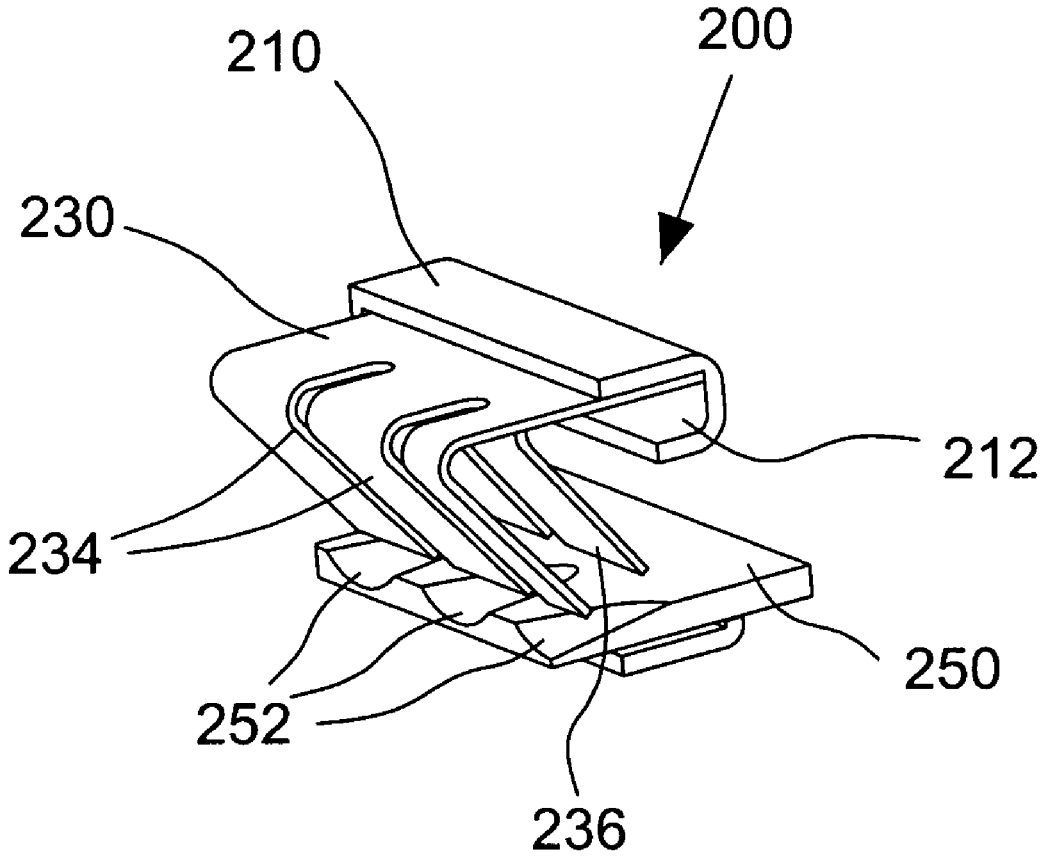
FIG. 3 is a cut away perspective view of the conduction and retention element for the wire connector of FIG. 1.
Figure 4:
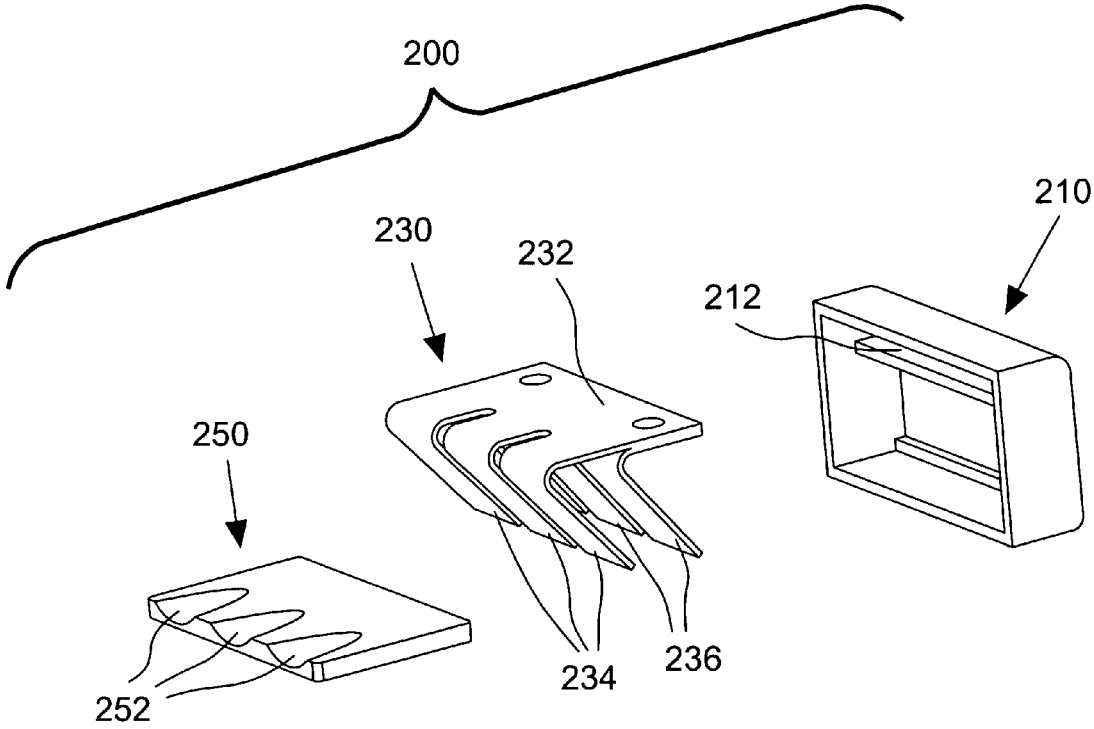
FIG. 4 is an exploded perspective view of the conduction and retention element of FIG. 3.

FIG. 3 is a cut away perspective view of the conduction and retention element 200 for the wire connector 10 of FIG. 1. The illustration shows the cross-sectional view of the element 200 cut along the A-A direction in FIG. 1. The conduction and retention element 200 in accordance with a preferred embodiment of the present invention comprises a supportive frame 210, a resilient wire retention means 230 and a conduction plate 250. FIG. 4 is an exploded perspective view of the conduction and retention element 200 of FIG. 3. As is illustrated, the supportive frame 210 is substantially in the shape of a framed mask that exhibits a generally rectangular footprint with rounded corners when observed along the direction of wire insertion into the connector. At the top side of the supportive frame 210, the frame wall forms a narrow slot 212 along substantially the entire length of that side.

The generally narrow, deep and long opening of the slot 212 faces toward the direction of wire insertion so that the edge of the horizontal top plate 232 of the resilient wire retention means 230 can be inserted therein in a secured manner. Width of the resilient wire retention means 230 in the direction orthogonal to the direction of wire insertion is substantially comparable with the length of the slot 212, which in turn runs substantially the entire width of the inner enclosing space 305 inside the enclosing element 300.

Extending from the edge of the horizontal top plate 232 of the resilient wire retention means 230 against the direction of wire insertion, a number of resilient spring legs 234 bend down and backward toward the direction of wire insertion. The total number of resilient spring legs 234 is corresponds to the total number of wire insertion ports 102 formed in the guide and lock element 100. The bending of the resilient spring legs 234 is preferably at an angle of less than 90 degrees with respect to the top plate 232. Preferably, a second set of resilient spring legs 236 bending at substantially the same angle extend from the bottom surface of the top plate 232 of the resilient wire retention means 230.

The conduction plate 250, as is illustrated in the exploded view of FIG. 4, is an electrically conductive metallic or alloy plate having a width substantially comparable with that of the resilient wire retention means 230. A number of curved recesses 252 corresponding to the total number of resilient spring legs 234 and 236 in each of the two rows of legs are formed on the top surface of the conduction plate 250. Each of the recesses 252 is, preferably, similar in the shape of a section of a cone, with the depth thereof at the front edge of the plate deeper than it is extended into the plate, as is illustrated in the exploded view of FIG. 4. When assembled as shown in the cut away view of FIG. 3, each of the curved recesses 252 is aligned with a corresponding one pair of the resilient spring legs 234 and 236 in the two rows.

As is comprehensible, supportive frame 210, resilient wire retention means 230 and conduction plate 250 are made of metallic or, preferably, alloy material. Alloy supportive frame 210 is advantageous in providing structural sturdiness for the entire assembled conduction and retention element 200 illustrated in FIG. 3. Alloy for the resilient wire retention means 230 can be selected to sustain resilience when the resilient spring legs 234 and 236 are slightly bent upward due to wire insertion. Alloy for the conduction plate 250, on the other hand, can be selected to provide good electrical conductivity. Preferably, conduction plate 250 should be made of copper alloy sheets with greater than 58 percent copper content. Also as is comprehensible, each and everyone of the supportive frame 210, the resilient wire retention means 230 and conduction plate 250 can be made via press-forming manufacturing technique.

In a preferred embodiment of the present invention, all parts for the conduction and retention element 200 are assembled into one single component. The assembled conduction and retention element 200 can then be mated with the guide and lock element 100 and then installed and locked inside the enclosing element 300. The assembly of the conduction and retention element 200 as one single component is achievable via, preferably, spot-welding the resilient wire retention means 230 and the conduction plate 250 onto the supportive frame 210.

FIG. 6 is a cross-sectional view of the wire connector shown in the exploded view of FIG. 1 as it is assembled using the three elements including the guide and lock 100, the conduction and retention 200 and the enclosing element 300. The cross-section view shows that the conduction and retention element 200 is matchedly and securedly fixed inside the structural body of the connector 10. This secured installation of the conduction and retention element 200 inside the enclosing element 300 and behind the guide and lock element 100 allows wires to be inserted into the wire connector 10 for facilitating electrical conduction therebetween. Compact and tight assembly of the three elements ensures that wire ends can be securedly held to the connector while sustaining good electrical conductivity between all the inserted wires.

Figure 7:
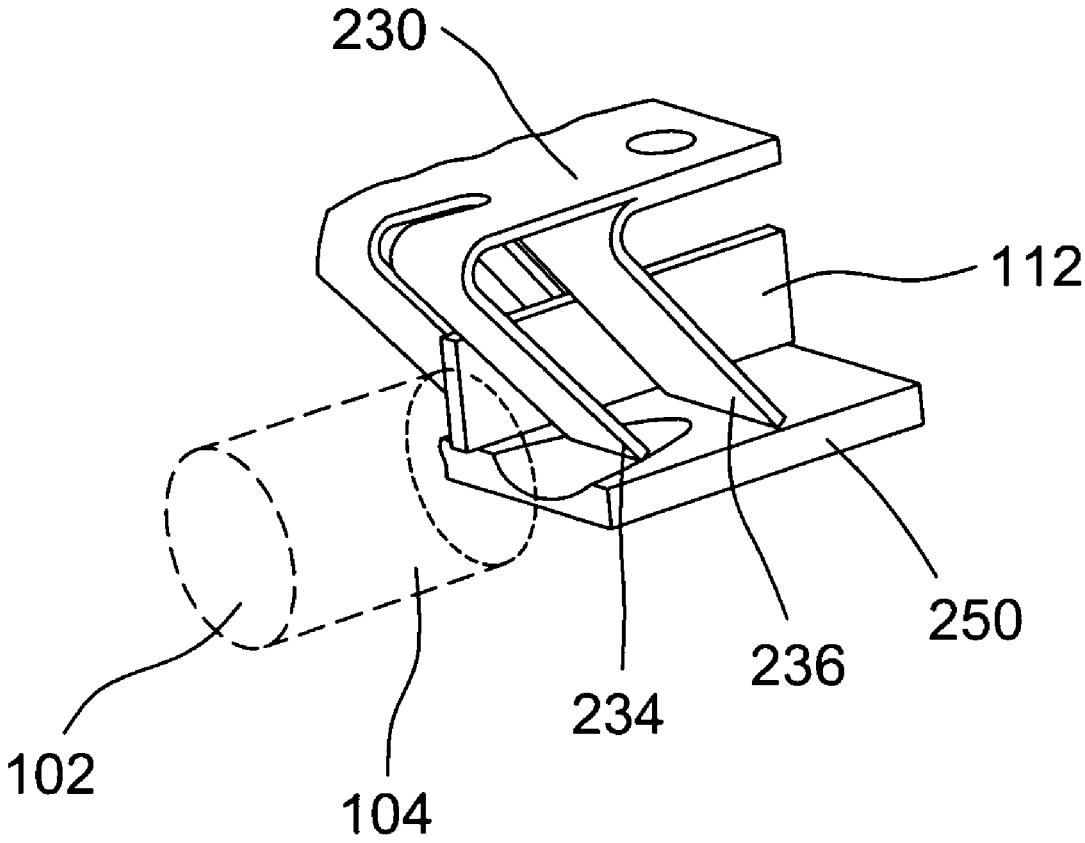
FIG. 7 schematically illustrates in perspective the configuration of a wire insertion channel for the wire connector in accordance with a preferred embodiment of the present invention.

FIG. 7 schematically illustrates in perspective the configuration of a wire insertion channel for the wire connector in accordance with a preferred embodiment of the present invention. Three wire insertion channels are present in the described embodiment of the present invention as depicted in the drawing. The imaginary wire insertion channel outlined in FIG. 7 starts with a main port section 104 (schematically shown in FIG. 7 in phantom as a cylindrical tube) led in from a wire insertion port (102 in FIG. 2) at left and then followed by a wire engagement segment to the right. The wire engagement segment, as shown in the drawing, is formed by the surrounding of the conduction plate 250 at the bottom, the insertion channel separation wall 112 at one or both sides, and the resilient spring legs 234 and 236 on the top.

In the depicted three-channel example of the drawing, the central channel has both sides surrounded by insertion channel separation walls 112 while the two side channels each has an insertion channel separation wall 112 at the inner side and the sidewall of the enclosing element 300 at the outer side.

Thus, all three wire insertion channels, whether central or side, has a wire engagement segment that has all sides properly enclosed. Such a complete four-way and all-surrounding enclosure prevents the inserted wire end from being bent sideways and deflects out of its assigned insertion channel. Each stripped wire end of a wire pushed into the connector can then pass on and enters into the wire end extension space 308 inside and at the back of the enclosing element 300. However, as is comprehensible, a wire connector in accordance with the present invention may also be made without a wire end extension space 308 inside and at the back of the enclosing element. This is because a stripped wire end of an inserted wire can be held secure within the wire engagement segment of its insertion channel.

While the above is a full description of the specific embodiments, various modifications, alternative constructions and equivalents may be used. Therefore, the above description and illustrations should not be taken as limiting the scope of the present invention, which is defined by the appended claims.

What is claimed is:

1. An electrical wire connector for connecting wires electrically together, said connector comprising:

a guide and lock means having at least one separation wall extending along the direction of insertion of said wires;

a conduction and retention means having at least one resilient spring leg and a conduction plate; and an enclosing means enclosing said guide and lock means mated with said conduction and retention means for securedly holding said conduction and retention means therein;

wherein said at least one separation wall, said at least one resilient spring leg and said conduction plate form a wire engagement segment for completely surrounding a stripped end of each of said wires inserted thereby preventing said stripped wire end from deflecting out of a wire insertion channel leading along said direction of insertion of said wire into said wire engagement segment.

2. The connector of claim 1 wherein said conduction and retention means further comprises a supportive frame, said supportive frame supporting said at least one resilient spring leg and said conduction plate and forming a single structural element for mating with said guide and lock means.

3. The connector of claim 1 wherein said guide and lock means further comprising at least two wire insertion ports each leading to a main port section for receiving the insertion of a stripped end of said wires.

4. The connector of claim 3 wherein said wire engagement segment being positioned behind said main port section of said guide and lock means.

5. An electrical wire connector for connecting wires electrically together, said connector comprising:

a guide and lock means having at least two wire insertion ports each leading to a main port section for receiving the insertion of a stripped end of said wires and at least one separation wall extending behind said main port section along the direction of insertion of said wires;

a conduction and retention means having at least one resilient spring leg and a conduction plate; and an enclosing means enclosing said guide and lock means mated with said conduction and retention means for securedly holding said conduction and retention means therein;

wherein said at least one separation wall, said at least one resilient spring leg and said conduction plate forming a wire engagement segment behind said main port section of said guide and lock means for completely surrounding said stripped wire end inserted thereby preventing said stripped wire end from deflecting out of a wire insertion channel.

6. The connector of claim 5 wherein said conduction and retention means further comprises a supportive frame, said supportive frame supporting said at least one resilient spring leg and said conduction plate and forming a single structural element for mating with said guide and lock means.

7. An electrical wire connector for connecting wires electrically together, said connector comprising:

a guide and lock means having at least two wire insertion ports each leading to a main port section for receiving the insertion of a stripped end of said wires and at least one separation wall extending behind said main port section along the direction of insertion of said wires;

a conduction and retention means comprising a resilient wire retention means having at least one resilient spring leg and a conduction plate; and an enclosing means enclosing said guide and lock means mated with said conduction and retention means for securedly holding said conduction and retention means therein;

wherein said at least one separation wall, said at least one resilient spring leg and said conduction plate forming a wire engagement segment behind said main port section of said guide and lock means for completely surrounding said stripped wire end inserted thereby preventing said stripped wire end from deflecting out of a wire insertion channel.

8. The connector of claim 7 wherein said conduction and retention means further comprises a supportive frame, said supportive frame having a slot for receiving a top plate of said resilient wire retention means thereby supporting said at least one resilient spring leg and said conduction plate and forming a single structural element for mating with said guide and lock means.

9. An electrical wire connector for connecting wires electrically together, said connector having an enclosing means enclosing therein a conduction and retention means mated with a guide and lock means, said guide and lock means having at least one separation wall, said conduction and retention means having at least one resilient spring leg and a conduction plate, said connector comprising:

at least one wire insertion channel, each of said wire insertion channel comprising a wire engagement segment formed by said at least one separation wall, said at least one resilient spring leg and said conduction plate surrounding said wire insertion channel for completely surrounding a stripped end of each of said wires inserted thereby preventing said stripped wire end from deflecting out of said wire insertion channel.

10. An electrical wire connector for connecting wires electrically together, said connector having an enclosing means enclosing therein a conduction and retention means mated with a guide and lock means, said guide and lock means having at least one separation wall, said conduction and retention means having at least one resilient spring leg and a conduction plate, said connector comprising:

at least one wire engagement segment formed by said at least one separation wall, said at least one resilient spring leg and said conduction plate surrounding a wire insertion channel leading into said wire engagement segment for completely surrounding a stripped end of each of said wires inserted thereby preventing said stripped wire end from deflecting out of said wire insertion channel.

* * * * *